US008113605B2

(12) United States Patent
Ceballos-Godefroy

(10) Patent No.: US 8,113,605 B2
(45) Date of Patent: Feb. 14, 2012

(54) FOLDABLE DISPLAY MODULE

(76) Inventor: Ricardo Ceballos-Godefroy, Col. De Valle (MX)

( * ) Notice: Subject to any disclaimer, the term of this patent is extended or adjusted under 35 U.S.C. 154(b) by 308 days.

(21) Appl. No.: 12/446,423

(22) PCT Filed: Oct. 18, 2007

(86) PCT No.: PCT/IB2007/003210

§ 371 (c)(1),
(2), (4) Date: Oct. 1, 2009

(87) PCT Pub. No.: WO2008/047230

PCT Pub. Date: Apr. 24, 2008

(65) Prior Publication Data

US 2010/0314979 A1 Dec. 16, 2010

(30) Foreign Application Priority Data

Oct. 19, 2006 (MX) ..... PA/A/2006/012066

(51) Int. Cl.

| | |
|---|---|
| ***A47B 43/00*** | (2006.01) |
| *A47B 95/02* | (2006.01) |
| *A47B 81/00* | (2006.01) |
| *A47B 3/00* | (2006.01) |

(52) U.S. Cl. ..... 312/262; 312/244; 312/280; 108/115

(58) Field of Classification Search ..... 312/258, 312/262, 263, 280, 244; 108/115

See application file for complete search history.

(56) References Cited

U.S. PATENT DOCUMENTS

| | | | | |
|---|---|---|---|---|
| 3,434,769 | A * | 3/1969 | Salet | 312/258 |
| 3,806,219 | A * | 4/1974 | Ahmann | 312/265 |
| 4,099,809 | A * | 7/1978 | Leotta | 312/140.2 |
| 4,250,580 | A * | 2/1981 | Eichenauer | 5/93.1 |
| 4,417,774 | A * | 11/1983 | Bevan et al. | 312/108 |
| 4,579,401 | A * | 4/1986 | Mears | 312/258 |
| 5,315,935 | A * | 5/1994 | Weisenfels | 108/193 |
| 5,882,098 | A * | 3/1999 | Brown et al. | 312/258 |
| 6,036,289 | A * | 3/2000 | Marcoux | 312/231 |
| 6,039,418 | A * | 3/2000 | Thomas | 312/258 |
| 6,039,419 | A * | 3/2000 | Brown et al. | 312/262 |
| 6,189,594 | B1 * | 2/2001 | Carter | 160/135 |
| 6,705,234 | B1 * | 3/2004 | Miller et al. | 108/36 |
| 6,752,090 | B2 * | 6/2004 | Schenker et al. | 108/115 |
| 2003/0085640 | A1 * | 5/2003 | Chan | 312/262 |

(Continued)

FOREIGN PATENT DOCUMENTS

DE 8513468 U1 6/1985

(Continued)

*Primary Examiner* — David Dunn

*Assistant Examiner* — Ryan A Doyle

(74) *Attorney, Agent, or Firm* — Browdy and Neimark, PLLC

(57) ABSTRACT

A foldable display module is described which comprises one base formed by one lower and one upper left panel; one lower and one upper front panel, and one lower and one upper right panel. The base has one "collapsed" and one "upright" position as well as one cover hingedly attached to the upper front panel that in the base's "upright" position runs horizontally between the upper left and upper right panels; and, one shelf hingedly attached to back face of the upper front panel and running between the upper left and upper right panels. The module has one pair of posts projecting upwardly from the base and one board is coupled to its upper end. The board, posts and the base's right side and left side panels can be housed inside the front panels to fold the module.

18 Claims, 10 Drawing Sheets

U.S. PATENT DOCUMENTS

2005/0067927 A1 * 3/2005 Ho et al. ..... 312/258

FOREIGN PATENT DOCUMENTS

EP 0575275 A1 12/1993
EP 1897472 A1 * 3/2008
JP 8010110 A 1/1996
WO WO 2006136874 A1 * 12/2006

* cited by examiner

FOLDABLE DISPLAY MODULE

FIELD OF THE INVENTION

The present invention relates to the techniques employed in the manufacture and design of furniture, displays and counters used in public locations referred to as "points of sale" where goods and services are offered to the public, more particularly, it relates to a foldable display module.

BACKGROUND

In different places where public converge for the acquisition and promotion of products and services, such as exhibitions, conventions, information centers and so on, the use of furniture and displays is necessary so that people can make contact with suppliers and get to know their products. In this regard, a great variety of these pieces of furniture is available, and built in wood, metal, with shelves, partitions, however, in general terms, they are bulky, difficult to handle, and their transportation entails hardships as they occupy important footprint.

A known solution in the prior art for these problems, has been the creation of cardboard foldable furniture and displays. Nevertheless, their poor structural rigidity is a drawback, as items of considerable weight cannot be placed thereon, and furthermore, it is impossible for the vendor to lean on such furniture. One example of a cardboard display is described in the European patent EP 0 575 275 A1, incorporated herein by reference. In addition, this type of cardboard furniture lacks a remarkable aesthetic appearance, an important factor in order to achieve a commercial impact for the product or service being offered.

Furthermore, there exists furniture with a countless panels, rods and posts joined to each other, however, assembly thereof results in a time-consuming activity because the pieces to be assembled together are numerous.

Nevertheless, furniture is available that has been widely accepted and practical for the above purposes, such displays are comprised of a base, a cover on top of the base and a board placed over the cover. In this type of displays, the board serves to identify the name of the supplier or the product being offered, whereas the supplier stands behind the module to deal with the customers approaching the same.

One of these displays is described in the Mexican patent No. 212, 227, on which, its most important feature being that the elements of the module are taken apart and stored in the shape of a portfolio. In the module of this patent, is included a hinged shelf inside the base. However, an issue with this module is that the shelf and the post sections holding the board move inside the base when they are stored therein. In addition, when the module is assembled, the posts and the board lack sufficient stability, furthermore, the pins employed to close the cover are external and, therefore, become an aspect prone to flaws.

The module of the above patent was restructured in the Mexican patent No. 225,710, in which, the most outstanding changes are the inclusion of 45° cutouts between the post sections and a second shelf that runs over a rail, as well, a support was included to maintain the post sections fixed inside the second shelf. Despite this change, the board continues being unstable, as it sways over the cover, furthermore, the shelves frequently fall off their horizontal position, because they snap in place between the lateral panels of the base at their free lateral ends only. Furthermore, the cover (portfolio body) has strength issues when the module is stored therein, particularly, the cover is prone to break apart while being handled and transported. More specifically, it is perceived that when the cover is hit at its bottom, the impact travels through the lateral faces and reaches the cover which in turn breaks apart.

Another issue, is the occurrence of scratches on the panels of the base every time it is taken in or out of the cover. Likewise, it is noticed that when the base is inside the cover, the former moves upwards and downwards, and therefore wears out.

In order to solve the module issues from Mexican patents No. 212,227, and No. 225,710, the former was improved as shown in the international patent application No. PCT/IB2005/002083; in this application means for supporting and firmly holding the shelves in place are proposed when the module is collapsed, i.e. the shelves do not move when the module is carried around as a portfolio. In addition, one of the shelves is slidable in order to readily place in a horizontal position when the module is assembled. Modifications are also incorporated thereto that enhance the strength of the cover, which is the part that acts as a case to store the base along with the board and the posts inside the same. It is worth mentioning that this type of modules that folds in the shape of a portfolio can be purchased in Mexico under the Quick Counter® brand.

Now, this module satisfies the needs for the services and products offered at "points of sale" because of its ruggedness. However, one of its drawbacks is that the cover is independent from the base and, therefore, it continuously attaches and detaches thereof, which in turn delays the assembly process of the entire module to a certain extent. Likewise, since the cover includes a handle to carry the module, pins to close the same, cushioning pads and reinforcing corner pieces, the cover needs a detailed manufacturing process. Furthermore, aluminum hinges are employed to hingedly attach the module's base panels, which therefore increase the weight that is in the range of around 13 Kg.

In the market the needs of certain customers to foldable displays could be met in a different manner, i.e., if such consumers do not require such a rugged and resistant module as those stored away in the shape of a portfolio, there exists the need to provide display modules with a reduced number of elements to be assembled, that is, lighter versions of a display module, yet with the stability, resistance and, over all, long durability that is, of course, unavailable in foldable cardboard modules.

SUMMARY OF THE INVENTION

Pursuant to the above, the purpose is to eliminate the drawbacks of either prior-art cardboard or portfolio-shaped display modules through the development of a foldable display module, with a reduced number of pieces to be assembled, less weight, yet with enhanced strength and durability.

The foldable display module of the present invention comprises one base, posts that are assembled at the base and a board to be assembled over the posts, from these elements, the base has a "collapsed" and an "upright" position; the base comprising: i) one lower left lower panel; ii) one upper left panel hingedly attached to the lower left panel; iii) one lower front panel hingedly attached to the lower left panel; iv) one upper front panel hingedly attached to the upper left panel; v) one lower right panel hingedly attached to the lower front panel; vi) one upper right panel hingedly attached to the lower right panel and hingedly attached to the upper front panel.

Furthermore, the base has as another of its element: vii) one cover hingedly attached to the upper front panel that, in the base's "upright" position runs horizontally between the upper left and upper right panels on top thereof. In this regard, it is important to highlight that in the inventions by the same inventor of the current invention, the cover was independent from the base, therefore, in the foldable display module of the present invention, one element separated that has to be assembled can be dispensed with.

The final component of the base is viii) one shelf hingedly attached to the upper front panel's back face; in the base's "upright" position, the shelf runs horizontally between the upper left and upper right panels.

Each one of panels i) through vi) and the shelf consist of a frame and a plate that attaches over the corresponding frame. In order to allow the base to reach its "collapsed" position, the shelf frame is sized such that it can be housed inside the upper front panel frame; the upper left panel frame and the upper right panel frame are sized such that both can be housed inside the upper front panel frame by pressing the shelf. Similarly, the lower left panel frame and the lower right panel frame are sized such that both can be housed inside the lower front panel frame.

Other essential elements of the display module, are a pair of posts, one of which is detachably joined, by its lower end, to the upper left panel frame and the other post is detachably installed to the upper right panel frame. Each post goes through said cover when the base is in its "upright" position, wherein, each post is further formed by post sections that assemble between each other and that can be housed in the shelf frame.

The final element of the display module is a board detachably joined to the upper end of said posts; the board is sized such that it can be housed in the lower front panel frame.

In order to fold the module, the board is detached from the posts and housed inside the lower front panel frame; the shelf is moved upwardly to be housed inside the upper front panel frame; the post sections are disengaged and are housed inside the shelf frame; the upper left and upper right panels move towards each other by the back face of the upper front panel, leaving the frame of each one of the panels housed inside the upper front panel frame by pressing the shelf.

To continue with the folding of the module, the lower left and lower right panels move towards each other by the back face of the lower front panel, and so the frame of each one of these panels is housed inside the lower front panel frame and pressing the board already housed. Afterwards, the cover is rotated backwards of the upper front panel in order to cover the upper left and upper right panels; and, the lower front panel with the lower left and lower right panels housed therein, moves upwardly to be positioned over the cover, thereby achieving the base's "collapsed" position where the board and posts are stored therein, and therefore folding of the display module comes to an end.

In a preferred embodiment of the present invention, the module further comprises a flange hingedly attached to the lower face of the cover and extending downwards thereof, the flange being attached both to the upper left panel frame and the upper right panel frame; this feature improves the module stability as a whole, particularly at the base's upper part.

In an additional aspect of the invention, means are provided to grasp the module when is in the folded position, these means preferably comprise a curve-shaped opening provided on the cover close to its front edge.

Likewise, in order to hold the post sections in the shelf frame, and according to another embodiment of the invention, the module is provided with fastening means in such shelf frame for said post sections, thereby the posts are restrained from movement inside the display module when its is carried around.

Now then, in the present invention, second fixing means are provided as well to fix the shelf on the upper left and upper right panel frames, this fixation further enhances the stability of the base and of the entire module when the latter is fully assembled.

From the above, an object of the present invention is to provide a foldable display module of low weight, yet rugged and durable.

Another object of the present invention, is to provide a foldable display module wherein the cover thereof is an element hingedly attached to the base for easy assembly of the entire module.

BRIEF DESCRIPTION OF THE DRAWINGS

The novelty aspects deemed as unique to the present invention, shall be specifically set forth in the appended claims. Nevertheless, the invention, both in terms of its structure and manufacturing procedure thereof, along with other objects and advantages thereof, shall be better understood with the following detailed description of a preferred embodiment, when read in conjunction with the accompanying drawings, wherein:

DETAILED DESCRIPTION OF THE INVENTION

Figure 1:
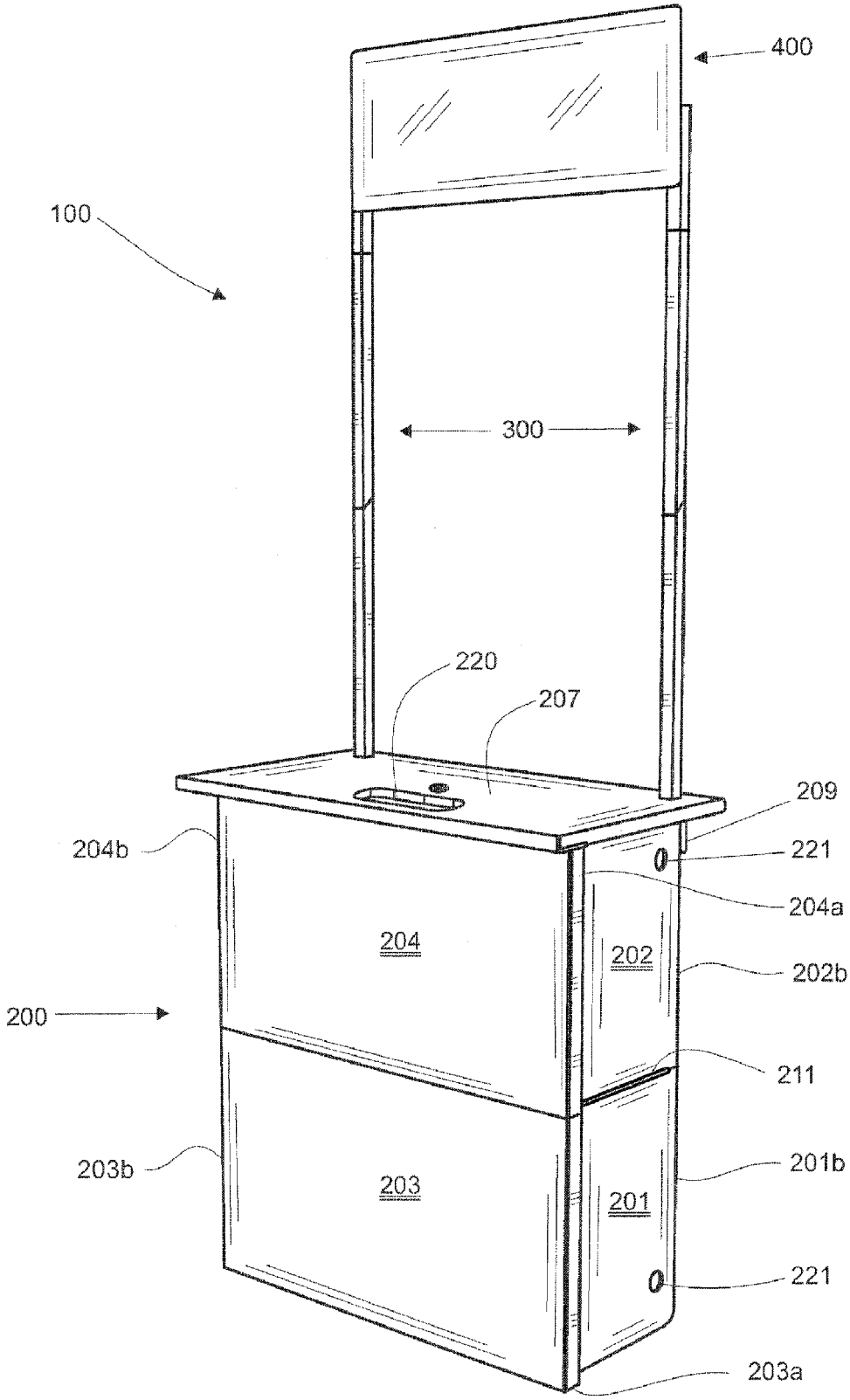
FIG. 1 is a front left perspective view of a foldable display module built in accordance with one preferred embodiment of the present invention.
Figure 4:
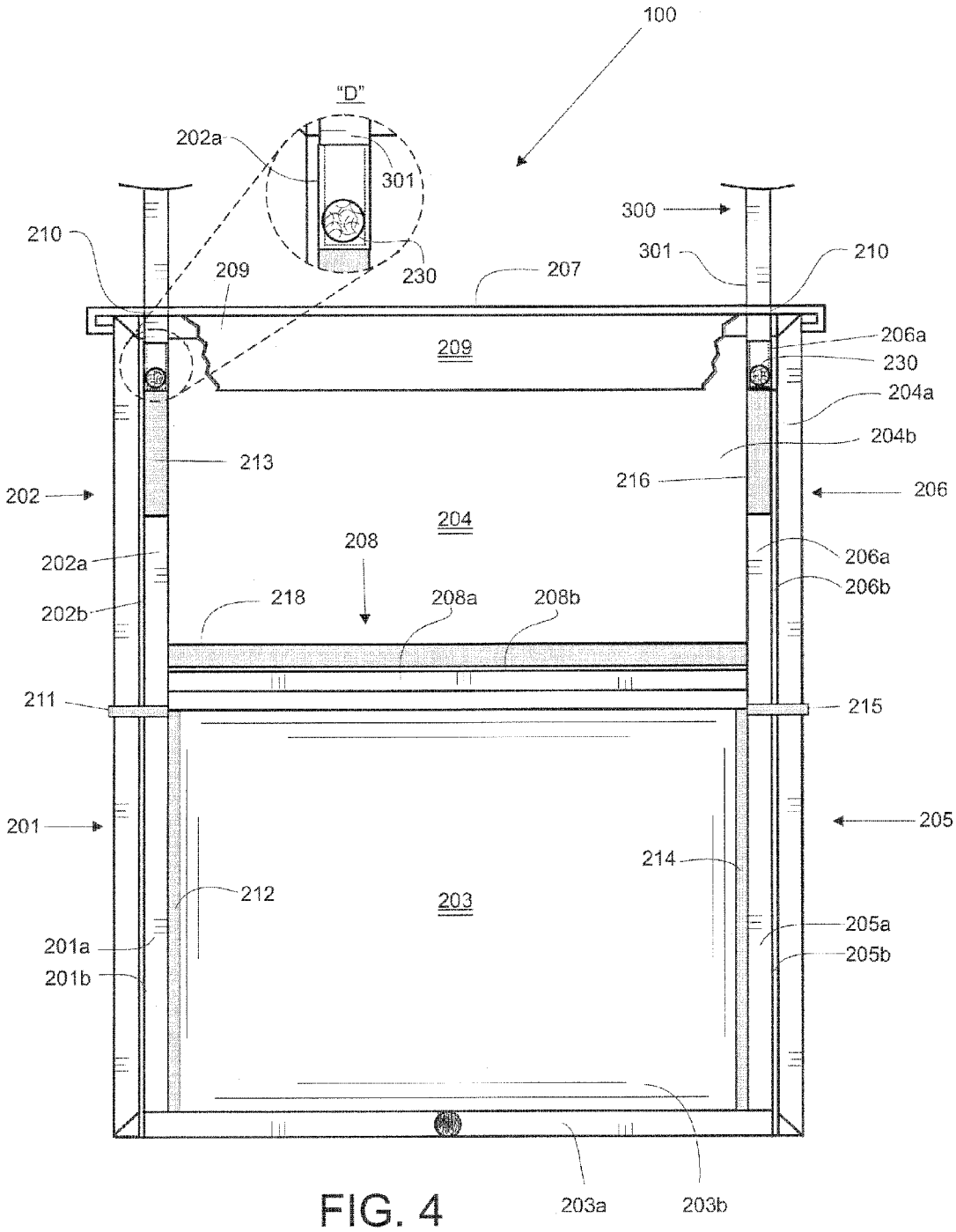
FIG. 4 is a back fragmented view of the lower part of the foldable display module of FIG. 1.

By reference to the accompanying drawings, and more specifically, to FIG. 1 through 4 thereof, they show a foldable display module 100, which is built according to one preferred embodiment of the present invention, which is to be considered as illustrative rather that limitative to the present invention. In the present detailed description, the module's left, right, front and back orientations of the module are those perceived by a user thereof if he/she would stand behind the module to wait on a customer. The foldable display module 100 comprises one base 200 consisting of the following panels:

i) one lower left panel identified with the number reference 201; this panel is formed by the frame 201*a* on top of which the plate 201*b* is attached;

ii) one upper left panel 202 hingedly attached to the lower left panel 201 by means of a first hinge 211; the upper left panel 202 comprises the frame 202*a* and the plate 202*b* that covers such frame 202*a*;

iii) one lower front panel 203 hingedly attached to the lower left panel 201 by means of a second hinge 212 that is shown in FIG. 4; the lower front panel 203 is formed by the frame 203*a* and the plate 203*b* that covers the frame 203*a;* iv) one upper front panel 204 hingedly attached to the upper left panel 202 by means of a third hinge 213 (see FIG. 4); the upper front panel 204 comprises the frame 204*a* and the plate 204*b* covering the same, the front panels 203 and 204 provide as a whole a wide surface that allows displaying of graphic material of different types by the front part of the module 100;

v) one lower right panel 205 hingedly attached to the lower front panel 203 by means of a fourth hinge 214; the lower right panel 205 is formed by the frame 205*a* on top of which the plate 205*b* is located; and, vi) one upper right panel 206 hingedly attached to the lower right panel 205 by means of a fifth hinge 215 and hingedly attached to the upper front panel 204 by means of a sixth hinge 216; the upper right panel 206 comprises the frame 206*a* and the plate 206*b* covered by said frame 206*a*.

From a different perspective, the right side, the left side and the front face of the base are divided into an upper part and a lower part, which differs from the base structure of the display module from the international patent application No. PCT/IB2005/002083, wherein the right and left sides thereof are not divided in that way, and further wherein the front panel is divided into one left and right front panel. In the present invention, the hinged relationship of panels 201 through 206 will allow for the collapsing of the base in a simple manner, thereby achieving a compact structure that, in the end, will simplify transportation of the entire module as will be further described below.

The base 200 has as an additional element one cover 207 hingedly attached to the upper front panel 204 by means of a seventh hinge, not shown in FIGS. 1 through 4, but displayed afterwards: As shown, the cover 207 runs horizontally between the upper left 202 and upper right 206 panels over the same. In this regard, in is convenient to point out that in prior art inventions by the same author, the cover is independent from the base, therefore, the foldable display module 100 has one less separate element that has to be assembled. The cover 207 is shaped as a single piece and the edges thereof are rounded to improve the aspect of the module.

The remaining component of the base 200 is a shelf 208 hingedly attached by the back face of the upper front panel 204 by means of an eighth hinge 218. The shelf comprises the frame 208*a* and the plate 208*b* that covers such frame 208*a*. The frame is facing downwards, i.e. the plate 208*b* has a wide working surface to place several items thereon. In the "upright" position of the base 200, the shelf 208 runs horizontally between the upper left 202 and upper right 204 panels, and furthermore, the shelf 208 lies on the frame 202*a* from the upper left panel 202 and the frame 206*a* from the upper right panel 206.

In the preferred embodiment described, there exists one flange 209 hingedly attached to the lower face of the cover 207, this flange 209 attaches both to the frame 202*a* from the upper left panel 202 and to the frame 206*a* from the upper right panel 206 by first fixing means, which in the embodiment described are circular portions 230 of Velcro® (hook and fiber fixing portions) that are adhered to the contact surfaces between the flange 209, the frame 202*a* from the upper left panel 202 and the frame 206*a* from the upper right panel 206. This feature is clearly visible in detail "D" of FIG. 4, wherein the flange 209 portion attached to the frame 202*a* has been removed, being it understood that said removed portion also includes one hook and fiber fixing portion (Velcro®) to fix the flange 209.

The foldable display module 100 has one pair of posts 300, one of which can be detachably joined, by its lower end, to the frame 202*a* from the upper left panel 202 and the other post is detachably joined to the frame 206*a* from the upper right panel 206. Each post 300 goes through said cover 207 past one hole 210 shaped on the base 200 when the latter is in an "upright" position. Assembling of each post 300 with either the frame 202*a* or the frame 206*a* can be seen particularly in detail "A" of FIG. 3 and in detail "D" of FIG. 4. The fact that the posts 300 are attached to the frames of the upper left 202 and upper right 206 panels allows the construction of a framework or framing for the entire module and prevent the post from moving.

Figure 3:
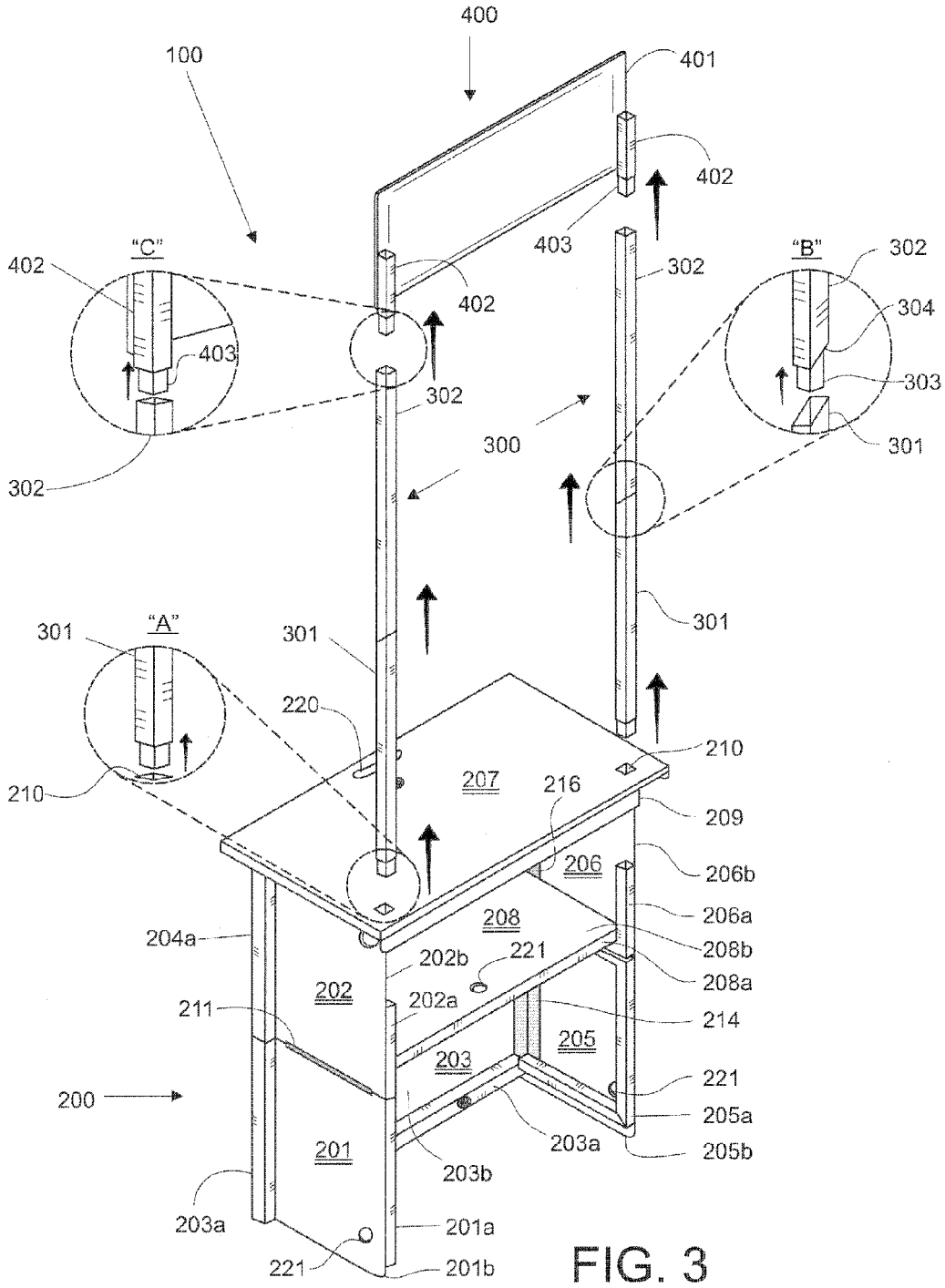
FIG. 3 is a back left and exploded perspective view of the foldable display module shown in FIG. 1.

With preferred emphasis on FIG. 3, it can be mentioned that each post 300 is formed by post sections that assemble between each other, in the preferred embodiment illustrated and described, the posts 300 are hollow, preferably with a squared cross section, although they may have a circular cross section as well. The posts 300 comprise a lower section 301 and an upper section 302 that engage between each other; out of those sections, the upper section 302 includes in its lower end one engaging portion 303 with tubular profile that has a reduced diameter than that of the upper section 302 to form a projection; wherein, in order to assemble each post 300, the engaging portion 303 from the upper section 302 is fully housed inside the upper end of the lower section 301 until the upper section 302 contacts the lower section 301. Preferably, the upper end of the lower section 301 and the lower end of the upper section 302 include diagonal cuts 304 at 45° to provide stability to each one of the posts already assembled (see detail "B" from FIG. 3 for further reference to this engagement). The lower and upper post sections 301 and 302 will be housed inside the frame 208*a* of the shelf 208 when the base 200 is in its "collapsed" position, as will be described later.

Figure 2:
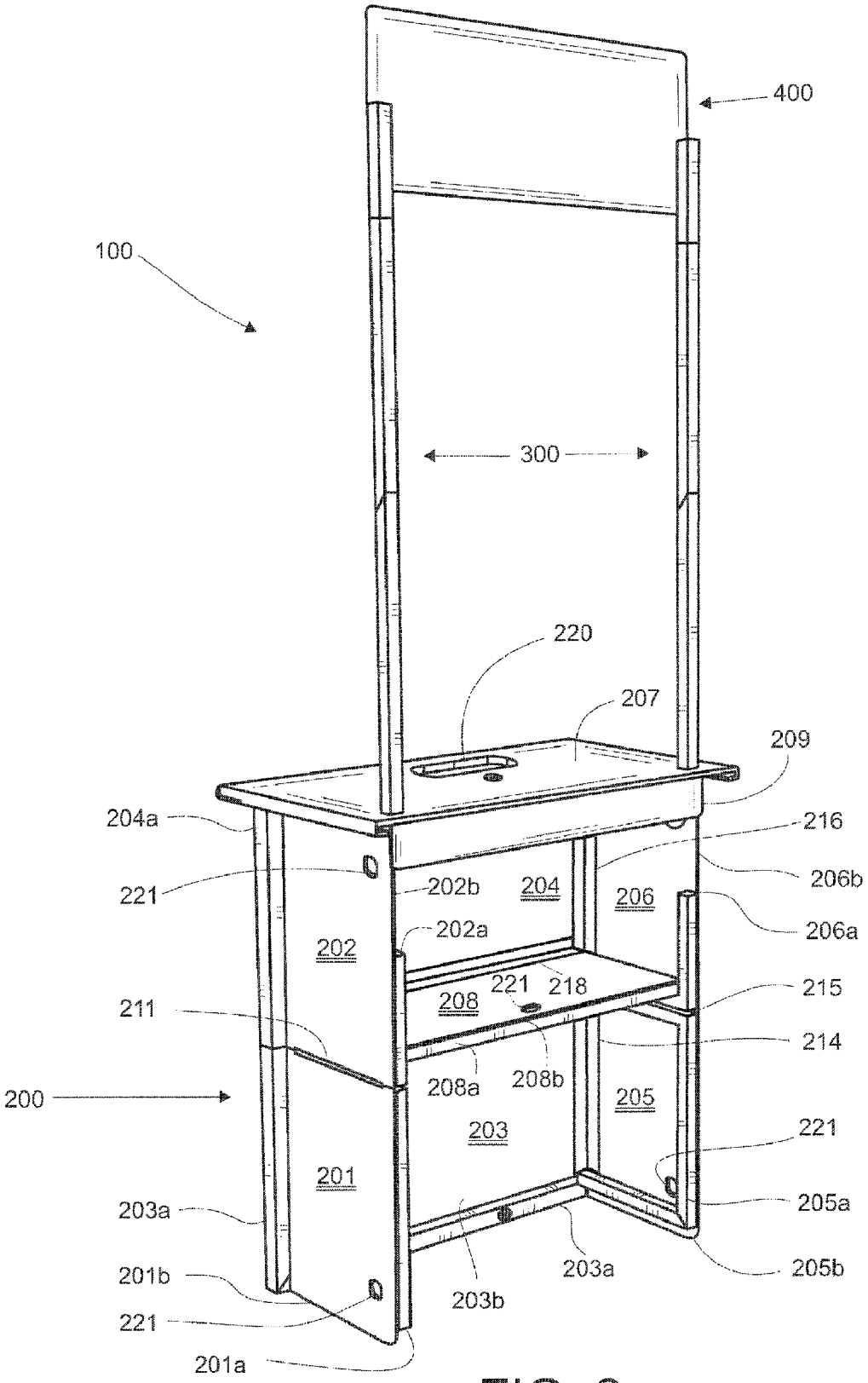
FIG. 2 is a back left perspective view of the foldable display module shown in FIG. 1.

From FIGS. 1 through 3, it can be observed as well that the display module 100 has one board 400 detachably joined to the upper end of each one of these posts 300. Graphic materials such as signs and posters can be placed on top of the board 400 surface, in order to identify the supplier's products and services at the point of sale. Particularly referring to FIG. 3, it can be see that the board 400 comprises one sheet 401 and one pair of mounting bases 402 attached to the back part of the board 400, each of the mounting bases 402 includes in its lower end one engaging segment 403 of tubular profile that is housed and joined inside the lower end of the base 402, thereby forming one projection. Through this engaging segment 403, the board 400 is engaged to the upper end of the upper section 302 of each post 300, in particular, detail "C" from FIG. 4 shows this engagement of the board 400 with the upper section 302. The board 400 will be housed inside the lower front panel frame to fold the module 100.

The display module of the present invention comprises means to grasp the same when in the folded state, in FIGS. 1 trough 3, it can be seen that such means are provided on the cover 207 in the shape of an opening 220 through which a user can introduce the hand in order to carry the module when in the folded state, which will be evident throughout the text and drawings. The opening 220 has a curved shape and is provided on cover 207 close to its front edge. In addition to said opening 220, the means to grasp the module can be selected too from the group consisting of a handle, a strap or holder adhered to the cover 207.

Another feature of the module is that the lower left 201, upper left 202, lower right 205, upper right 206 panels and the shelf 208 have perforations 221 (FIGS. 1 through 3) through which it is possible to pass cables or connections of electric or electronic devices that users employ at the module 100 to serve customers, e.g., trough the perforations 221, a keyboard cable or a electronic point of sale terminal etc. can be connected.

Figure 6:
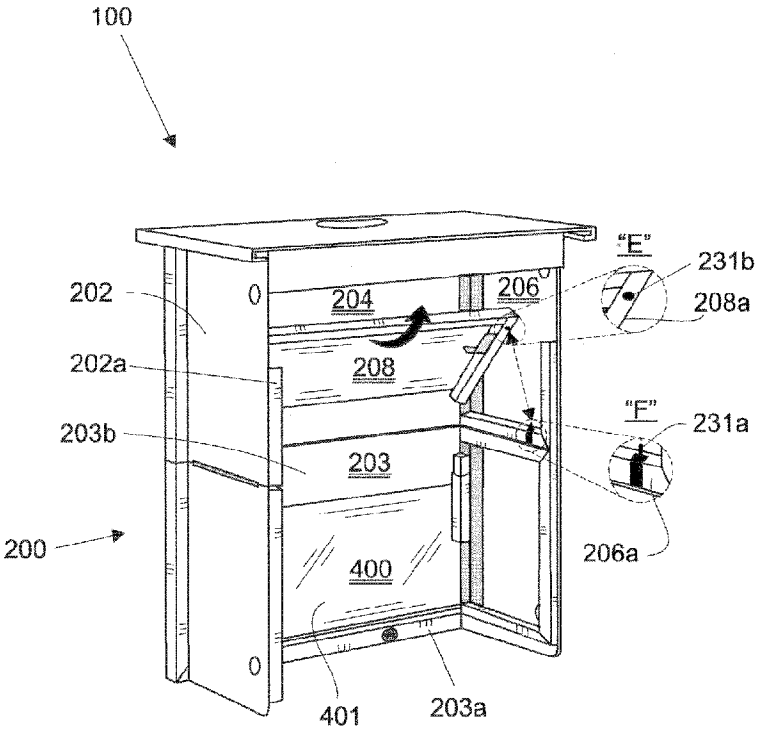
FIGS. 5-12 show the sequence for the folding of the display module of FIG. 1.
Figure 5:
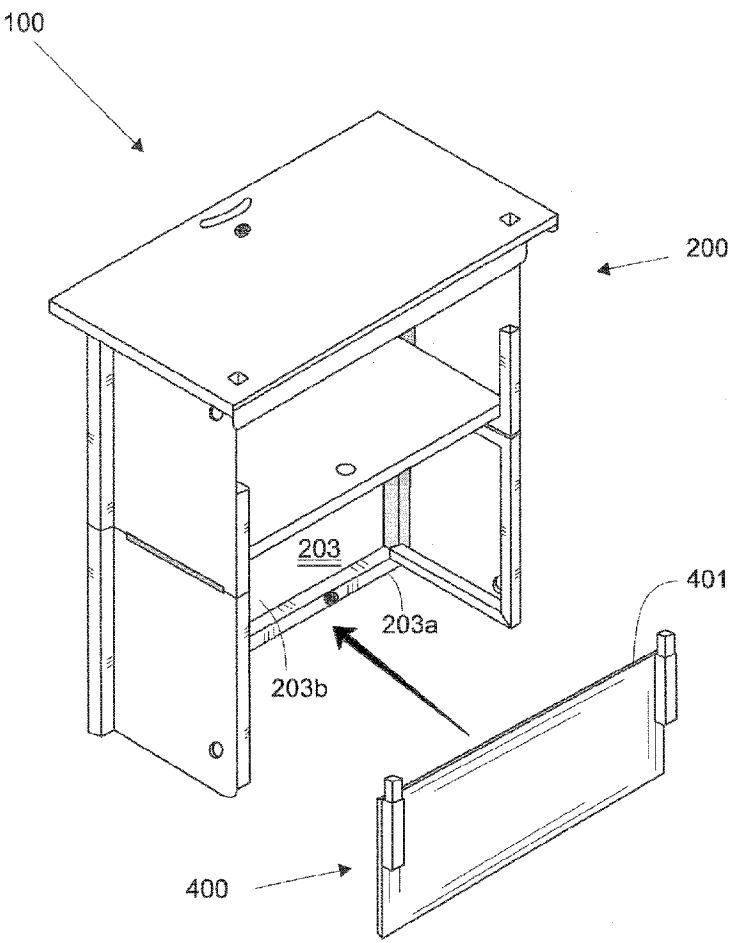

Reference is now made to FIGS. 5 through 12 with the purpose of describing the manner in which the elements of the module are disengaged and stored inside the base 200 to fold the module 100. In the first place and as shown in FIG. 5, the board 400 already disassembled from the posts will be housed inside the frame 203*a* of the lower front panel 203; in particular the sheet 401 from the board 400 contacts the plate surface 203*b* from the lower front panel 203 leaving the board 400 duly housed as shown in FIG. 6.

Still referring to FIG. 6, once the board 400 is housed inside the frame 203*a* of the lower front panel 203, the shelf 208 moves upwardly towards the upper front panel 204. However, it is convenient to point out that, when the base 200 is upright, the shelf 208 is fixed to the frame 202*a* from the upper left panel 202 and to the frame 206*a* from the upper right panel 206, for such purpose second fixing means are used, that can be selected from male-female couplings, hook and fiber fixing portions (Velcro®) or pins.

Preferably, and as shown in details "E" and "F" from FIG. 6, the second fixing means employed in the embodiment being described, are male-female couplings 231A and 231B provided on the frame 206*a* of the upper right panel 206 and on the frame 208*a* of the shelf 208, where it is observed as well that the male component 231A is provided at the frame 206*a* from the upper right panel 206, and the female component 231B is provided at the lower face of the right side of the frame 208*a* from the shelf 208. Although not perceivable in FIG. 6, this same feature is also included at the left side of the module 100, i.e., the frame 202*a* from the upper left panel 202 includes the male component and, at the lower face of the left side of the frame 208*a* from the shelf 208, the female component is incorporated.

Figure 7:
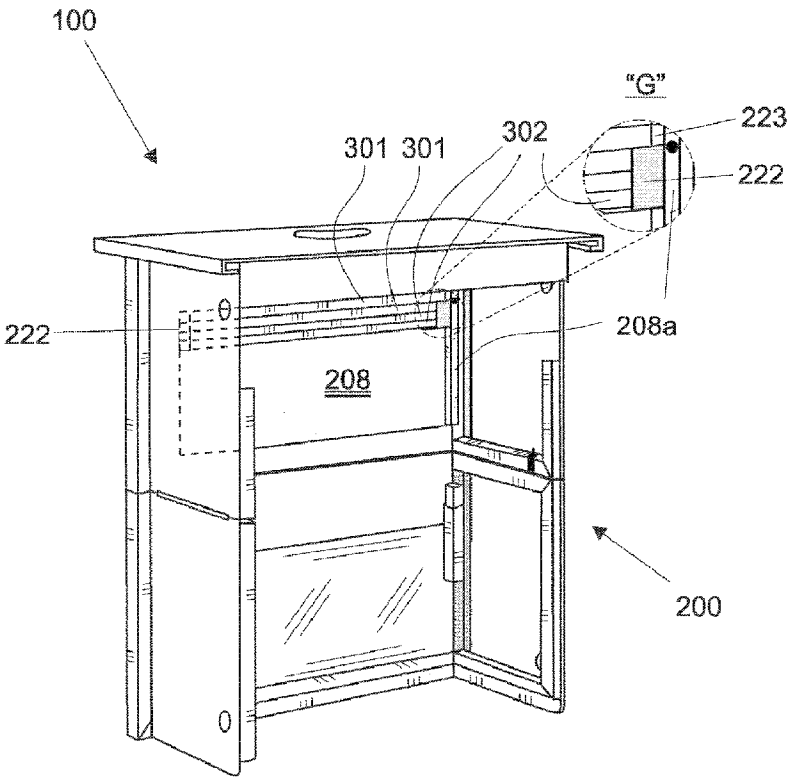

To continue with the folding of the module 100, the posts are detached from the base 200 and their post sections 301 and 302 are disengaged from each other to be housed inside the frame 208*a* of the shelf 208 (FIG. 7). In this regard, in the module 100, are included means to hold the post sections 301 and 302 to the shelf frame 208, specifically said means comprise one pair of cartridges 222 spaced from each other a distance corresponding to the length of the post sections. One of the cartridges 222, is attached in the right side of the frame 208*a* from the shelf 208 and the remaining cartridge in the left side of the same frame 208*a*. Each cartridge 222 receives and covers one end portion of the post sections 301 and 302 in order to retain the same. One of these cartridges 222, particularly the one located at the right side of the shelf 208, has an inlet 223 by means of which the sections 301 and 302 can be introduced and taken out of both cartridges, as shown in detail "G" from FIG. 7.

Figure 8:
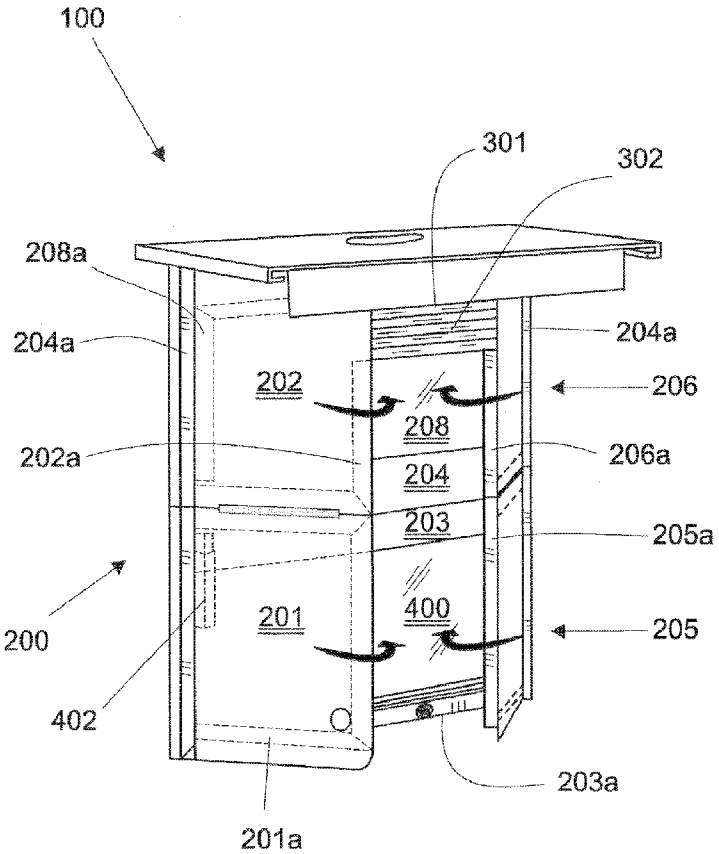

Reference is now made to FIG. 8, to point out that once the post sections 301 and 302 are stored inside the shelf frame 208, the upper left 202 and upper right 206 panels move one towards the other by the back face of upper front panel 204, staying the frame 202*a* and 206*a* from said upper left and upper right panels 202 and 206 housed inside the frame 204*a* from the upper front panel 204 by pressing the shelf 208. In a similar fashion, the lower left 201 and lower right 205 panels move similarly, i.e., one towards the other by the back face of the lower front panel 203, staying the frame 201*a* and 205*a* thereof housed, respectively, inside the frame 203*a* from the lower front panel 203 and pressing the board 400.

Figure 9:
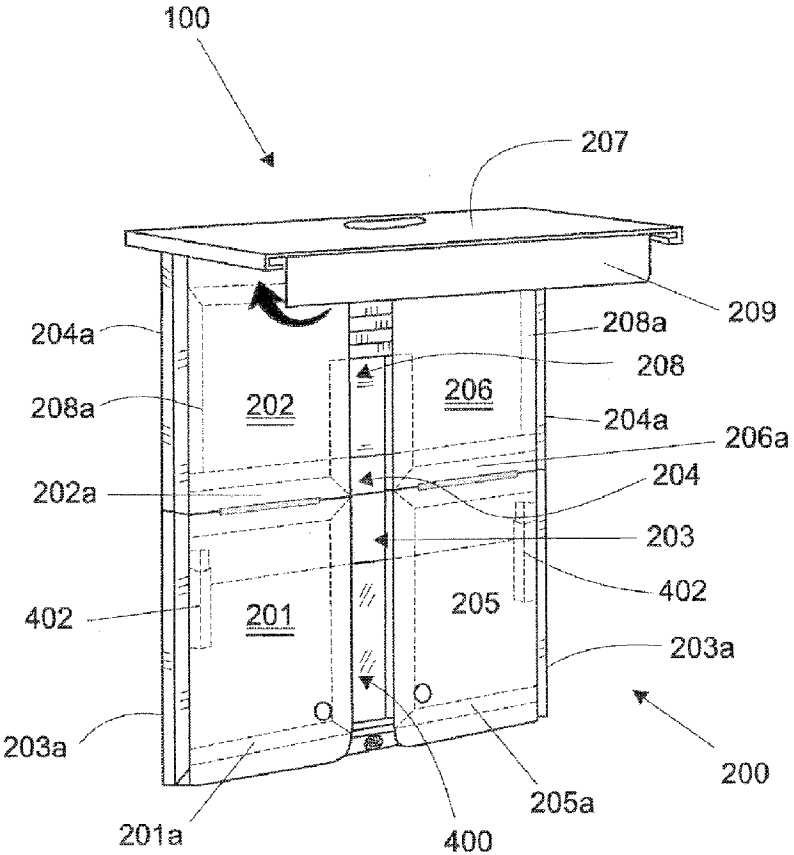

One important feature to be pointed out and that can be explained from FIGS. 8 and 9 is that, the frame 208*a* of the shelf 208 and the frames from each one of the panels 201 through 206 of the base 200, are preferably open rectangular frames, i.e., frames that can be devoid of one side at least so as to not interfere with the frames where they are being housed. For instance, the frame 201*a* from the lower left panel 201 and the frame 205*a* from the lower right panel 205 are identical, and have three sides, its missing side being the front one; the latter is with the purpose of preventing that such frames 201*a* and 205*a* crash against the mounting bases 402 of the board 400, when such board is housed inside the frame 203*a* of the lower front panel 203.

In a similar fashion and still referring to FIGS. 8 and 9, the frame 202*a* from the upper left panel 202 and the frame 206*a* from the upper right panel 206 are identical, their missing side being the front one to prevent it from crashing against the lateral sides of the frame 208*a* from the shelf 208 already housed; and, additionally, the frames 202*a* and 206*a* have their back side with a partial length, i.e., with a missing portion so that when the shelf 208 is housed and pressed the frames do not crash against the post sections 301 and 302 already housed in the shelf 208. In FIGS. 8 and 9 some portions of the frames 201*a*, 202*a*, 205*a* and 206*a*, 208*a* and the mounting bases 402 are shown in broken lines for the sake of clarity.

Figure 10:
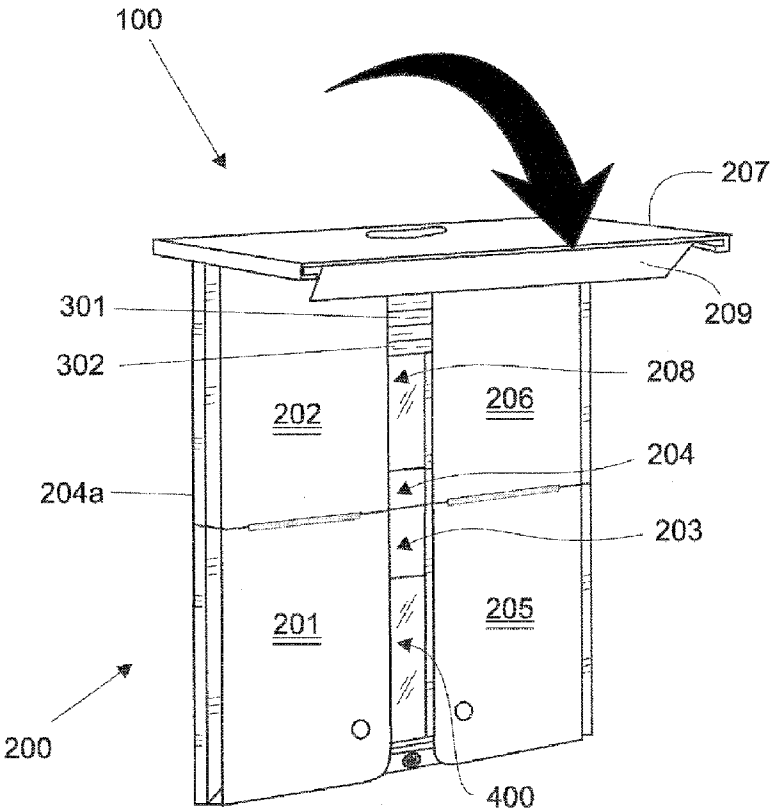

Reference is now made to FIG. 10, to mention that once the board 400, the shelf 208, the post sections 301 and 302, as well as the lower left 201, upper left 202, lower right 205 and upper right 206 panels are already housed; the flange 209 moves towards the cover 207, and the latter rotates in the direction of the upper left 202 and upper right 206 panels housed in the frame 204*a* from the upper front panel 204.

Figure 12:
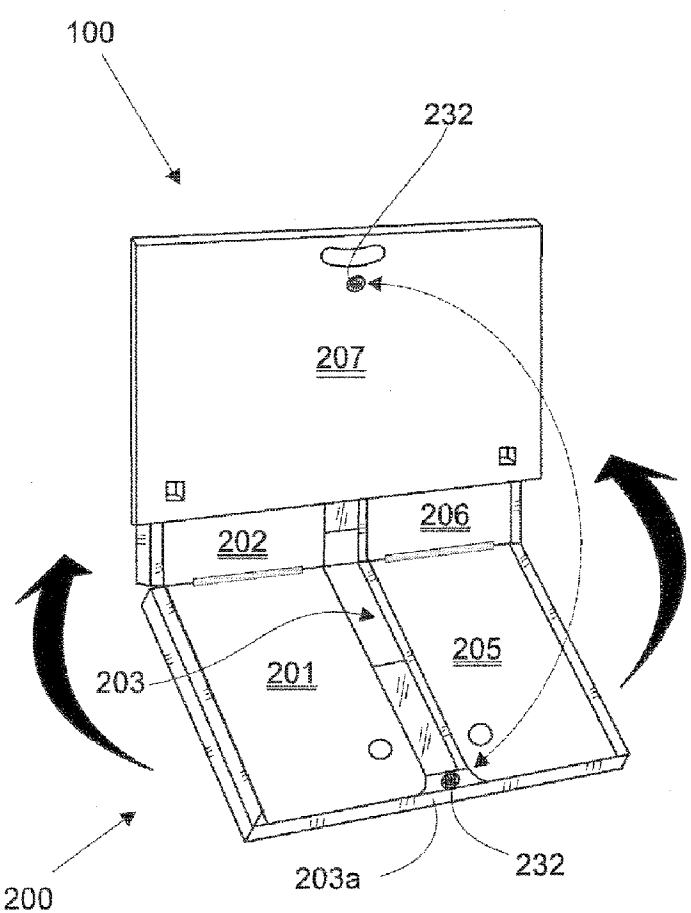
Figure 11:
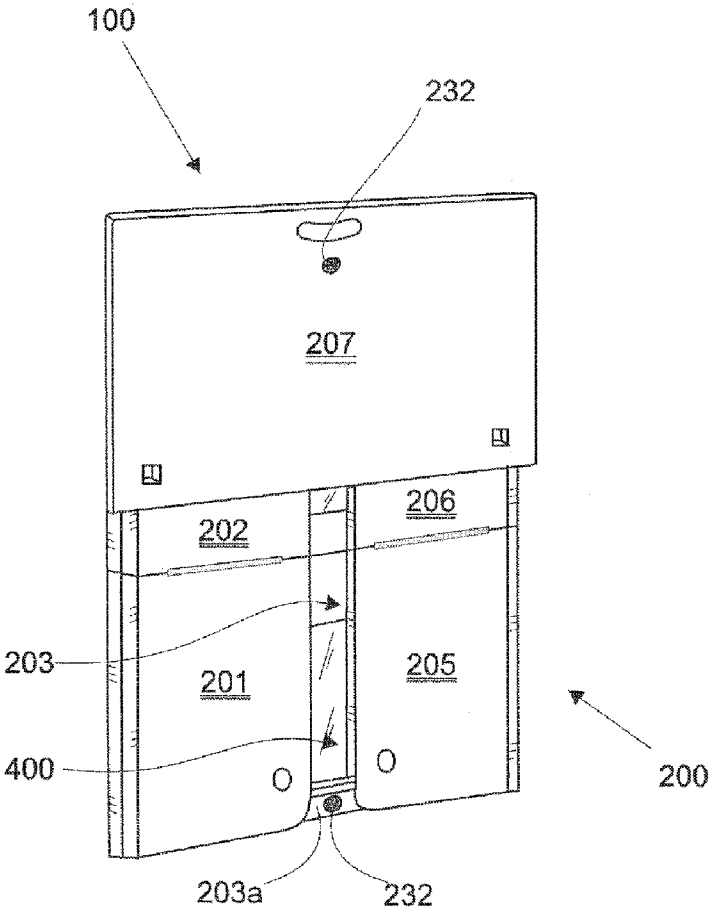

Now and with reference to FIGS. 11 and 12, the lower front panel 203 along with the lower left panels 201 and lower right panels 205 housed in the frame 203*a* moves upwardly to stay on top of the cover 207 to reach the collapsed position of the base 200 wherein the board 400 the post sections are housed therein. It is convenient to point out that the lower front panel 203 remains fixed to the cover with the help of third fixing means, thereby avoiding that the module 100 opens and loses its folded state, these third fixing means preferably comprise hook and fiber fixing portions (Velcro®) 232 provided in the frame 203*a* from the lower front panel 203 and at the cover surface 207, the location of these Velcro® portions 232 on the frame 203*a* and on the surface of the cover is such that when the base 200 is collapsed, said portions 232 match.

Figure 13:
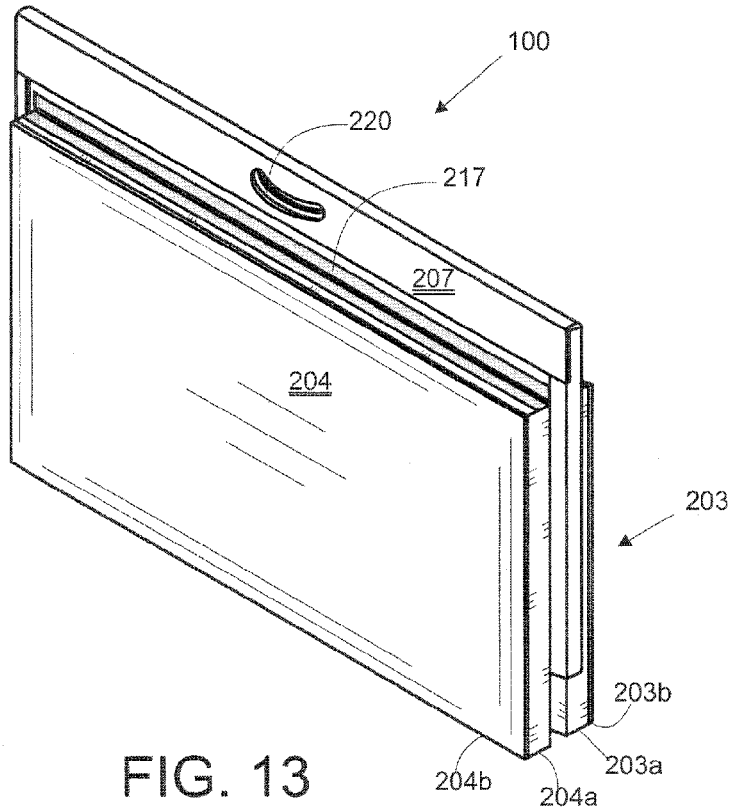
FIG. 13 is a front perspective view of the display module already folded.
Figure 14:
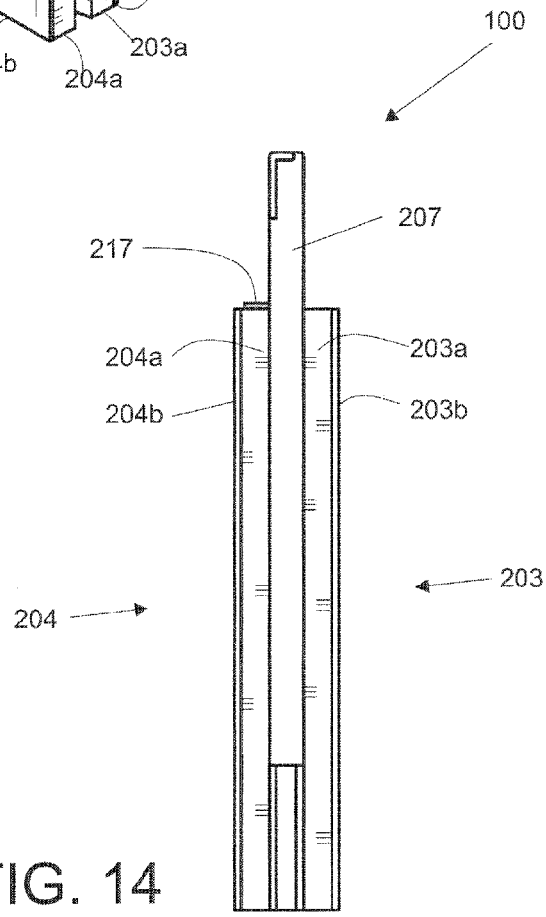
FIG. 14 is a left side view of the display module shown folded in FIG. 13.
Figure 15:
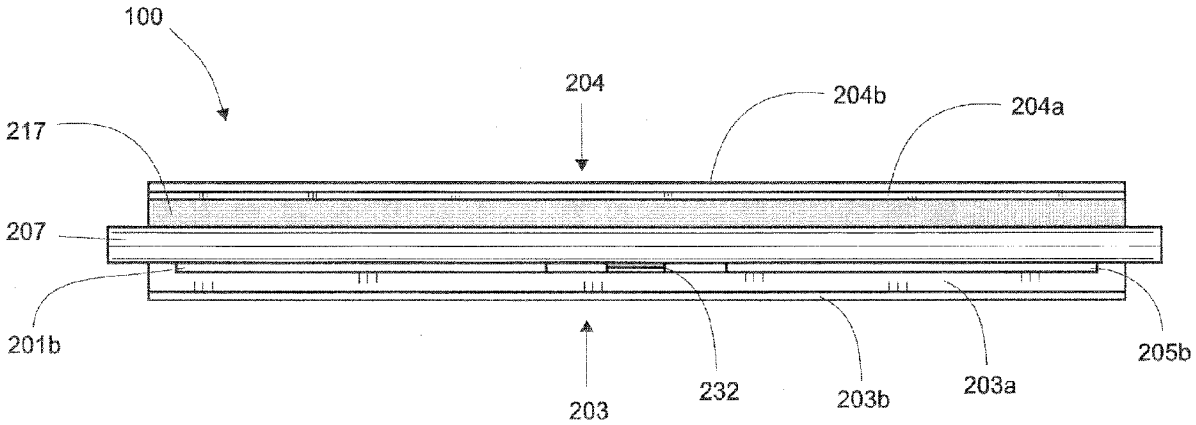
FIG. 15 is a top plan view of the folded display module of FIG. 13.

FIGS. 13 through 15 show the manner in which a user sees the module 100 in the folded state. From the folded module 100 one portion of the cover 207 sticks out with the opening 220 for a user to introduce his hand and carry the module. The cover section 207 where the opening 220 is located would correspond to the front part of the cover 207 when the module is in the assembled state (see FIGS. 1 through 4 for further reference). In the folded module 100, the lower front panel 203 and the upper front panel 204 can be seen, with their corresponding frames 203*a* and 204*a* and corresponding plates 203*b* and 204*b*. As previously mentioned, the cover 207 is hingedly attached to the upper front panel 204, by means of the seventh hinge 217.

In particular, FIG. 15 which is an upper plan view of the display module 100 already folded, the plates 201*b* and 205*b* from the lower left and lower right panels can be slightly seen, in addition the hook and fiber fixing portions (Velcro®) 232 can also be observed, by means of which the module 100 is prevented from opening and losing its folded position.

Figure 16:
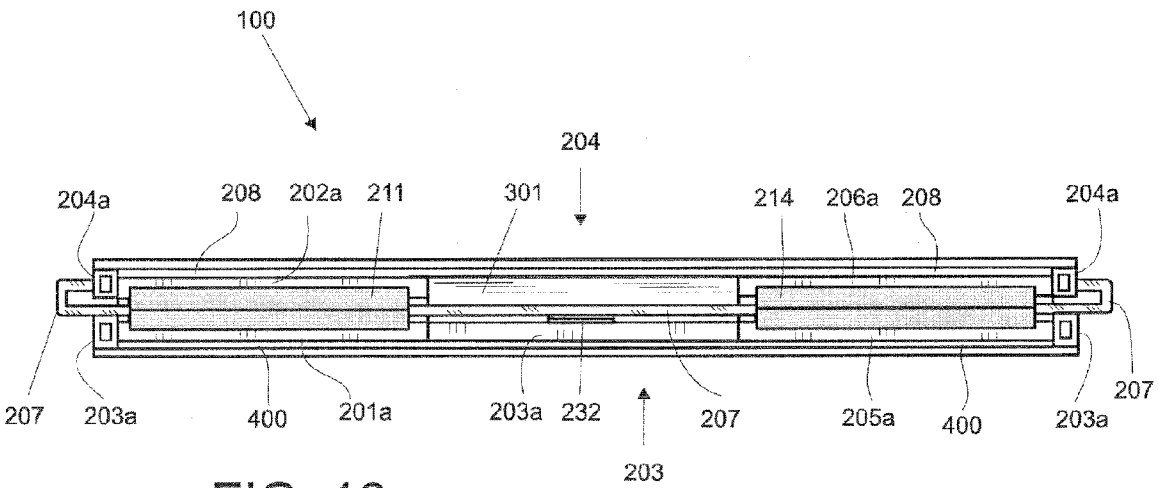
FIG. 16 is a lower plan view of the display module already in the folded position of FIG. 13.

Now, particularly referring to FIG. 16, which shows a lower plan view of the folded module 100, this figure let show the manner in which the frames 202*a* and 206*a* from the upper left and upper right panels respectively are housed inside the frame 204*a* from the upper front panel, it also shows how the shelf 208 is housed inside the frame 204*a* from the upper front panel 204. In addition, inside the shelf frame 208 the post sections are housed therein, from which one of the upper sections 301 can be seen.

In a similar fashion FIG. 16 shows the manner in which the frames 201*a* and 205*a* from the lower left and lower right panels are housed inside the frame 203*a* of the lower front panel 203. It should not be forgotten that the board 400 is housed inside the frame 203*a*. In FIG. 16, the hook and fiber fixing portions (Velcro®) 232 can be seen, by means of which the cover 207 and the frame 203*a* of the lower front panel become attached so that the module 100 does not open and loses its folded state. This same FIG. 16 also clearly shows the first hinge 211 that hingedly joins the lower left and upper left panels, the first hinge 211 is attached to the frames 201*a* and 202*a* of such panels of the left side of the module. The fourth hinge 214 is also observed that joins the lower right and upper right panels; the fourth hinge 214 is fixed to the frames 205*a* and 206*a* from such panels of the right side of the module 100.

As Can be seen, the structural relationship among the elements of the display module allows an easy folding thereof, however, it allows to form a resistant module. The commercial version of the module of the present invention is very light in weight with a maximum weight of around 6.5 Kg, which accounts for almost half the weight of prior art modules, since the frames, panels and hinges are preferably manufactured in PVC. More specifically, the post sections, the panel frames and the shelf frame are manufactured of extruded PVC profiles; the hinges employed are plastic hinges that adhere to the plates or to the frames without the need to make perforations as would be required for metal hinges, however, any type of hinges can be used. On the other hand, the panel plates and the cover itself are manufactured in foamed PVC.

Although one preferred embodiment of the present invention has been described and exemplified, it should be stressed that numerous modifications thereto can be made, such as the type of hinges employed, the manufacturing materials, the shape of the posts or the separation thereof from the cover. Therefore, the present invention shall not be deemed as limiting except for the teachings of the prior art and by the scope of the appended claims.

The invention claimed is:

1. A foldable display module comprising: a) one base that has a collapsed position and an upright position, the base comprising: i) one lower left panel; ii) one upper left panel hingedly attached to the lower left panel; iii) one lower front panel hingedly attached to the lower left panel; iv) one upper front panel hingedly attached to the upper left panel; v) one lower right panel hingedly attached to the lower front panel; vi) one upper right panel hingedly attached to the lower right panel and hingedly attached to the upper front panel; vii) one cover hingedly attached to the upper front panel that, in the base's upright position, runs horizontally between the upper left and upper right panels on top thereof; and, viii) one shelf hingedly attached to the upper front panel's back face, and that runs between the upper left and upper right panels; wherein, each one of panels i) through vi) and the shelf consist of a frame and a plate that attaches over the corresponding frame; further wherein the shelf frame is sized such that it can be housed inside the upper front panel frame; the upper left panel frame and the upper right panel frame are sized such that both can be housed inside the upper front panel frame by pressing the shelf; and, the lower left panel frame and the lower right panel frame are sized such that both can be housed inside the lower front panel frame; b) one pair of posts, one of which is detachably joined by its lower end to the upper left panel frame and the other post is detachably joined to the upper right panel frame; each post goes through said cover when the base is in its upright position, wherein each post is further formed by post sections that engage between each other and can be housed in the shelf frame; and, c) one board detachably joined to the upper end of said posts and that can be housed inside the lower front panel frame; wherein, in order to fold the display module, the board is detached from the posts and is housed inside the lower front panel frame; the shelf is moved upwardly to be housed inside the upper front panel frame; the post sections are disengaged and are housed inside the shelf frame; the upper left and upper right panels move towards each other by the back face of the upper front panel, leaving the frame of each one of the panels housed inside the upper front panel frame by pressing the shelf; the lower left and lower right panels move towards each other by the back face of the lower front panel, and so the frame of each one of these panels is housed inside the lower front panel frame and pressing the board; afterwards, the cover is rotated backwards of the upper front panel in order to cover the upper left and upper right panels; and the lower front panel with the left and right panels housed therein, moves upwardly to be positioned over the cover such that the cover is positioned between the upper and lower front panels, thereby achieving the base's collapsed position, wherein the board and posts are stored therein and therefore folding of the display module comes to an end.

2. A foldable display module, according to claim 1, further comprising a flange hingedly attached to the lower face of the cover and extending downwards thereof; the flange being attached both to the upper left panel frame and the upper right panel frame.

3. A foldable display module, according to claim 2, further comprising first fixing means that fix the flange to the upper left panel frame and to the upper right panel frame.

4. A foldable display module, according to claim 3, wherein said first fixing means are hook and fiber fixing portions that are adhered to the contact surfaces between the flange, the upper left panel frame and the upper right panel frame.

5. A foldable display module, according to claim 1, further comprising means to grasp the module when in the collapsed position.

6. A foldable display module, according to claim 5, wherein said means to grasp the module are selected from an opening included on the cover, a handle, a strap or a holder.

7. A foldable display module, according to claim 6, wherein said means to grasp the module are a curve-shaped opening provided on the cover close to its front edge.

8. A foldable display module, according to claim 1, wherein in the base's upright position, said shelf lies horizontally on the upper left panel frame and the upper right panel frame.

9. A foldable display module, according to claim 8, wherein it comprises second fixing means to fix the shelf to the upper left panel frame and to the upper right panel frame.

10. A foldable display module, according to claim 9, wherein said second fixing means are selected from male-female couplings, hook and fiber fixing portions and pins.

11. A foldable display module, according to claim 10, wherein said second fixing means are male-females couplings, of which the male component is provided at the upper right panel frame and at the upper left panel frame, whereas the female component is provided at the lower face of the left side of the frame from the shelf and at the lower face of the lower right side of the frame from the shelf.

12. A foldable display module, according to claim 1, further comprising means for holding the post sections in the shelf frame when the module is folded.

13. A foldable display module, according to claim 12, wherein said means for holding are one pair of cartridges spaced from each other a distance corresponding to the length of the post sections.

14. A foldable display module, according to claim 13, wherein one of said cartridges is attached to the right side of the frame from the shelf and the remaining cartridge to the left side of the same frame, each cartridge covering one end portion of the post sections in order to retain the same.

15. A foldable display module, according to claim 14, wherein one of said cartridges has an inlet by means of which the sections can be introduced or stored inside the cartridges.

16. A foldable display module, according to claim 1, further comprising third fixing means to fix the cover to the lower front panel when the module is folded, thereby preventing the module from opening and losing its collapsed position.

17. A foldable display module, according to claim 16, wherein said fixing means are hook and fiber fixing portions provided on the cover surface and on the lower front panel frame.

18. A foldable display module, according to claim 1, wherein the lower left panel, upper left panel, lower right panel, upper right panel and the shelf have perforations through which it is possible to pass cables and connections of electric or electronic devices when the base is in its upright position.

* * * * *